US009819066B2

(12) United States Patent
Wang et al.

(10) Patent No.: US 9,819,066 B2
(45) Date of Patent: Nov. 14, 2017

(54) ADJUSTABLE COUPLING DEVICE AND RADIO FREQUENCY COMMUNICATION DEVICE

(71) Applicant: SHENZHEN TATFOOK TECHNOLOGY CO., LTD, Shenzhen, Guangdong (CN)

(72) Inventors: Hongwei Wang, Shenzhen (CN); Xiaoliang Xu, Shenzhen (CN); Xincai Huang, Shenzhen (CN); Wenjing Wu, Shenzhen (CN)

(73) Assignee: SHENZHEN TATFOOK TECHNOLOGY CO., LTD., Shenzhen, Guangdong Province (CN)

( * ) Notice: Subject to any disclaimer, the term of this patent is extended or adjusted under 35 U.S.C. 154(b) by 128 days.

(21) Appl. No.: 14/785,443

(22) PCT Filed: Nov. 15, 2013

(86) PCT No.: PCT/CN2013/087246

§ 371 (c)(1),
(2) Date: Oct. 19, 2015

(87) PCT Pub. No.: WO2014/075628

PCT Pub. Date: May 22, 2014

(65) Prior Publication Data

US 2016/0079648 A1 Mar. 17, 2016

(30) Foreign Application Priority Data

Nov. 16, 2012 (CN) ..... 2012 2 0609677

(51) Int. Cl.

| | |
|---|---|
| ***H01P 5/04*** | (2006.01) |
| ***H01P 3/08*** | (2006.01) |
| ***H01P 5/08*** | (2006.01) |

(52) U.S. Cl.
CPC ..... *H01P 5/04* (2013.01); *H01P 3/081* (2013.01); *H01P 5/085* (2013.01)

(58) Field of Classification Search
CPC ..... H01P 5/04; H01P 5/103; H01P 5/183
(Continued)

(56) References Cited

U.S. PATENT DOCUMENTS 5,867,020 A * 2/1999 Moore ..... G01R 1/06772 324/126
6,624,722 B2 * 9/2003 Wang ..... H01P 5/184 333/111

(Continued)

FOREIGN PATENT DOCUMENTS

| | | |
|---|---|---|
| CN | 101390249 A | 3/2009 |
| CN | 101471477 A | 7/2009 |
| CN | 101964436 A | 2/2011 |

*Primary Examiner* — Dean Takaoka
(74) *Attorney, Agent, or Firm* — Chen-Ju Chiang

(57) ABSTRACT

The present disclosure relates to the field of communication technologies, and more particularly, to an adjustable coupling device and a radio frequency communication device. The adjustable coupling device includes a coaxial transmission line for transmitting signals across the two terminals thereof and a coupling body for sampling the signals via coupling. The adjustable coupling device further includes a coupling cavity formed on the outer surface of the coaxial transmission line; a printed circuit board on which the coupling body is disposed, the printed circuit board capping the coupling cavity to seal the coupling body within the coupling cavity; a tuner, disposed through the printed circuit board, where the lower end of the tuner extends into the coupling cavity, and the tuner can be moved up and down to change the depth thereof extended into the coupling body so as to change the electromagnetic field distribution within the coupling cavity. In this way, the present disclosure has a simple structure and thus eliminates the influence on the (Continued)

coupling device derived from the structure and the machining accuracy and assembly techniques of printed circuit board, with simple tuning means and high reliability.

18 Claims, 8 Drawing Sheets

(58) Field of Classification Search
USPC ..... 333/109, 111, 116, 24 R
See application file for complete search history.

(56) References Cited

U.S. PATENT DOCUMENTS 7,183,876 B2 * 2/2007 Fallon ..... H01P 5/04 333/109
8,228,136 B2 * 7/2012 Subedi ..... H01P 5/183 333/111
8,294,530 B2 * 10/2012 Van Swearingen ... H01P 1/2007 333/113
9,300,026 B2 * 3/2016 Haunberger ..... H01P 5/12

* cited by examiner

Replacement Sheet

ADJUSTABLE COUPLING DEVICE AND RADIO FREQUENCY COMMUNICATION DEVICE

RELATED APPLICATION

This application is a national phase entry under 35 USC 371 of International Patent Application No PCT/CN2013/087246 filed on 15 Nov. 2013, which claims priority from Chinese Patent Application No 201220609677.1 filed on 16 Nov. 2012, the disclosures of which are incorporated in their entirety by reference herein.

FIELD OF THE DISCLOSURE

The present disclosure relates to the field of communication technologies, and more specifically, to an adjustable coupling device and a radio frequency communication device.

BACKGROUND OF THE DISCLOSURE

In a base station, a radio remote unit (RRU), a standing wave detection system and a feed system, a coupling device is generally used to check the signal power. Circuitry of an existing coupling device is shown as in FIG. 1, where J2 and J1 are respectively an input terminal and an output terminal for main signals, J3 an output terminal for coupling signals, J4 an isolation terminal, and Coupler the coupling portion of the coupling device. The coupling portion may be in the form of coupling sheet—metal main rod or microstrip line—metal main rod, and so on. An adjustable circuit for adjusting the coupling degree or isolation degree is respectively disposed at the coupling signal output terminal and isolation terminal. The adjustable circuit is mainly comprised of a capacitor, an inductor, a resistor, a tunable potentiometer, a variable capacitor, etc. It is configured to compensate for errors derived from machining accuracy of printed circuit board (PCB) or metal cavity, and errors derived from installation processes, and so on. Such a coupling device has the following drawbacks:

1. To achieve the required isolation specification and coupling specification, a coupling terminal adjustable circuit and an isolation terminal adjustable circuit would be needed. In actual tuning process, however, tuning the isolation terminal adjustable circuit will largely influence the coupling degree, while tuning the coupling terminal adjustable circuit will also influence the isolation degree, causing the tuning difficult.

2. With the increasement of the device's operating time, some adjusting components may be aging fast. The coupler may deteriorate dramatically in its performance, and even result in failure, causing communication failure of the device; components applied in the adjustable circuit may reduce the reliability of the device, thus increasing the failure rate of the device; components applied in the adjustable circuit may undergo wide parameters variation through high and low temperatures, thus making the communication device difficult to maintain a good working condition under various temperature environments; introduction of the adjustable circuit may lift up the raw material cost and production cost of the device.

Another existing coupling device is also available, in which an adjustment mechanism may be utilized to adjust the distance and angle between the coupling sheet and the metal main rod, thus achieving the adjustment of coupling amount of the coupling sheet and the adjustment of the signal phase. However, the circuit on the printed circuit board that is connected to the coupling circuit board is fixedly arranged, thus, the connections between the coupling sheet and other circuits may be unstable when the coupling sheet rotates, and implementations of which may be relatively complex, resulting in poor reliability of the coupling device.

SUMMARY OF THE DISCLOSURE

In view of the aforementioned deficiencies existing in the prior art, the present disclosure provides an adjustable coupling device and a radio frequency communication device, with simple structures. They eliminate the influence to the coupling device derived from the structure and the machining accuracy and assembly techniques of the printed circuit board, with easy tuning means and high reliability, and thus are favorable for mass production.

A technical solution adopted by the present disclosure to solve its technical issues is to provide an adjustable coupling device, comprising a coaxial transmission line configured to transmit signals across the two terminals thereof and a coupling body configured to sample the signals through coupling. The coupling device further comprises:

a coupling cavity applied on an outer surface of the coaxial transmission line;

a printed circuit board where the coupling body is fixedly disposed, the printed circuit board capping the coupling cavity so as to have the coupling body enclosed within the coupling cavity;

a tuner, disposed through the printed circuit board, wherein a lower end of the tuner extends into the coupling cavity and the tuner can be moved up and down so as to change the depth thereof extended within the coupling cavity.

According to the adjustable coupling device of the present disclosure, a window is defined on an outer conductor of the coaxial transmission line, and an annular protrusion is disposed surrounding the window outside the coaxial transmission line, so as to form the coupling cavity.

According to the adjustable coupling device of the present disclosure, the annular protrusion and the outer conductor of the coaxial transmission line are separately formed or integrally formed.

According to the adjustable coupling device of the present disclosure, the coupling body is a microstrip line.

According to the adjustable coupling device of the present disclosure, the coupling body is a metal sheet.

According to the adjustable coupling device of the present disclosure, the coupling body is fixedly attached on the bottom layer of the printed circuit board.

According to the adjustable coupling device of the present disclosure, a coupling output terminal and an isolation terminal electrically connected to the coupling body are also disposed on the top layer of the printed circuit board.

According to the adjustable coupling device of the present disclosure, a fixed load is disposed between the isolation terminal and the coupling body, and disposed on the top layer of the printed circuit board.

According to the adjustable coupling device of the present disclosure, a signal attenuator circuit is disposed between the coupling output terminal and the coupling body, and disposed on the top layer of the printed circuit board.

According to the adjustable coupling device of the present disclosure, the tuner can be moved up and down so as to change electric field vectors within the coupling cavity, making the coupling amount and signal phase at different portions of the coupling body that are coupled with the electric field different.

According to the adjustable coupling device of the present disclosure, when the tuner is in an optimal tuning position, multiple signals coupled to the isolation terminal of the coupling body by the electric field within the coupling cavity cancel out each other's power, with the output power of signals at the isolation terminal reaching the minimum.

According to the adjustable coupling device of the present disclosure, the tuner is a timing bolt.

According to the adjustable coupling device of the present disclosure, the tuner is secured on the printed circuit board by a tuner fixing means.

According to the adjustable coupling device of the present disclosure, the tuner fixing means is a nut or a metal deck fixed on the printed circuit board.

According to the adjustable coupling device of the present disclosure, the cross section of the coaxial transmission line is a circle or a square.

According to the adjustable coupling device of the present disclosure, the printed circuit board is closely connected to the annular protrusion so as to seal the coupling cavity.

The present disclosure also provides a radio frequency communication device accordingly, which comprises a signal transmission member and the above mentioned adjustable coupling device.

According to the radio frequency communication device of the present disclosure, the radio frequency communication device is a cavity filter, a simplex device, a duplexer, a multiplexer, a combiner or a demultiplexer.

In the present disclosure, a coupling cavity is formed on the outer surface of the coaxial transmission line, a printed circuit board caps the coupling cavity, and a coupling body disposed on the printed circuit board is enclosed within the coupling cavity. A tuner extends through the printed circuit board into the coupling cavity, and can be moved up and down to change the depth thereof extended within the coupling cavity so as to change the electromagnetic field distribution within the coupling cavity, and thus further make the coupling amount and signal phase at different portions of the coupling body different. When the tuner is tuned to the optimal position, multiple signals coupled to the isolation terminal of the coupling body by the electric field within the coupling cavity cancel out each other's power, making the output power of signals at the isolation terminal reach the minimum (i.e., attaining the greatest isolation degree), while having an extremely small influence on the output power at the coupling output terminal. A fixed load (configured to absorb the remaining signal power and produce the impedance matching effects) will only be needed at the isolation terminal of the coupling device to meet the isolation requirements. Due to the extremely small influence on the coupling output terminal, the coupling adjustable circuit won't be needed. The present disclosure thus obviates the conventional complex coupling circuit with high cost, high failure rate and high level of manufacturing difficulty. A tuner causes perturbation of the internal field within the coupling cavity to adjust the indicators (for example, the directivity) of the coupling device, thus compensating for indicator deterioration derived from various machining errors.

In tuning, one only needs to change the depth of the tuner extended within the coupling cavity, while the position of the coupling body remains stationary, and connection relations between the coupling body and other circuits on the printed circuit board are stable, thereby further improving the reliability and thus achieving much simpler tuning means and coupling device structure. In this way, the present disclosure has a simple structure and thus eliminates the influence to the coupling device derived from the structure and the machining accuracy and assembly techniques of the printed circuit board, with simple tuning means and high reliability. Meanwhile, the present disclosure is more favorable for mass production.

BRIEF DESCRIPTION OF THE DRAWINGS

Below a further description of the present disclosure will be provided with reference to the accompanying drawing and embodiments.

DETAILED DESCRIPTION OF THE DISCLOSURE

Below a definite and complete description will be made on technical solutions of embodiments of the present disclosure with reference to the accompanying drawings corresponding to embodiments of the present disclosure. Apparently, the described embodiments are merely some but not all of the embodiments of the present disclosure. Based on embodiments of the present disclosure, all other embodiments obtained by those of ordinary skill in the art without making inventive effort shall fall within the protection scope of the present disclosure.

Figure 1:
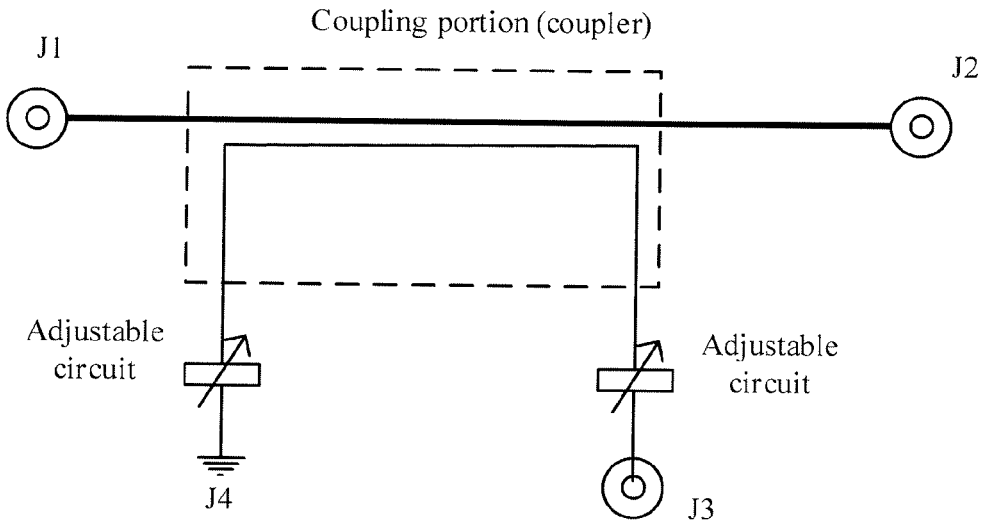
FIG. 1 PRIOR ART
FIG. 1 is a schematic circuit diagram illustrating a prior art coupling device.
Figure 2:
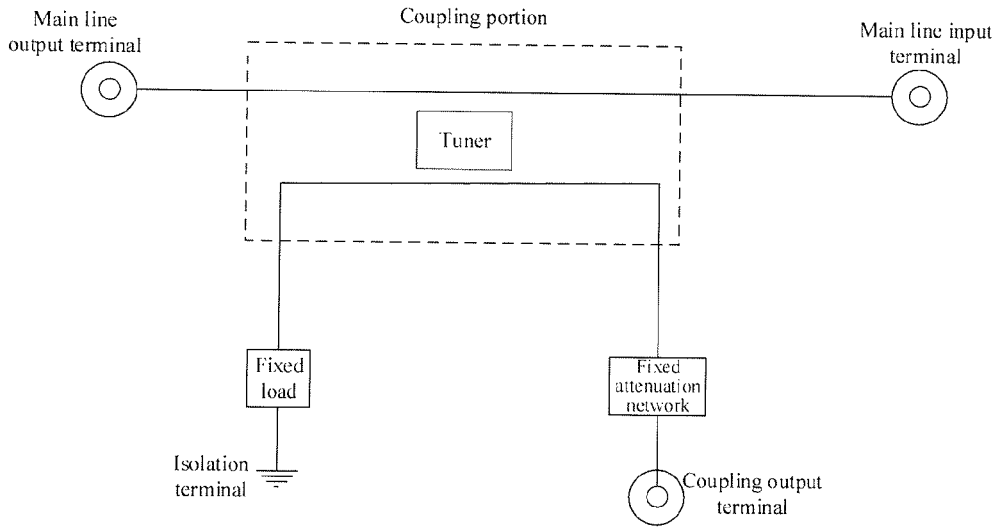
FIG. 2 is a schematic circuit diagram illustrating an adjustable coupling device according to the present disclosure.

Working principles of the adjustable coupling device of the present disclosure are as below: a coupling body is employed as a sub-line to couple the radio frequency signals transmitted from a main line, and a tuner is added to the coupling portion so as to tune the phase and strength of multiple signals coupled to the coupling body. At the isolation terminal, a fixed load is adopted to connect to the coupling body, while at the coupling output terminal, a fixed attenuation network is adopted to connect to the coupling body. A simple schematic circuit diagram is shown as in FIG. 2.

As is shown in FIGS. 3~6, the present disclosure provides an adjustable coupling device 100 comprising a coaxial transmission line 10 configured to transmit signals across the two terminals thereof, and a coupling body 20 configured to sample the signals through coupling. The coupling device 100 further comprises a coupling cavity 11, a printed circuit board 30 and a tuner 40. In the present embodiment, the main line is the coaxial transmission line 10.

The coupling cavity 11 is applied on an outer surface of the coaxial transmission line 10. More specifically, the coaxial transmission line 10 comprises an outer conduct 12 and an inner conductor 13. And a window is defined in the outer conductor 12, and an annular protrusion 121 is disposed surrounding the window outside the coaxial transmission line 10 so as to form the coupling cavity 11. The annular protrusion 121 is separately or integrally provided with the outer conductor 12 of the coaxial transmission line 10. The cross section of the coaxial transmission line 10 may be a circle or a square. The radius of the inner conductor 13 is generally in certain proportion to the radius of the outer conductor 12 so as to be matched to certain impedance. For example, with regards to a 50Ω coaxial transmission line, the ratio of the size of inner conductor 13 to that of the outer conductor 12 is 1:2.3.

Figure 3:
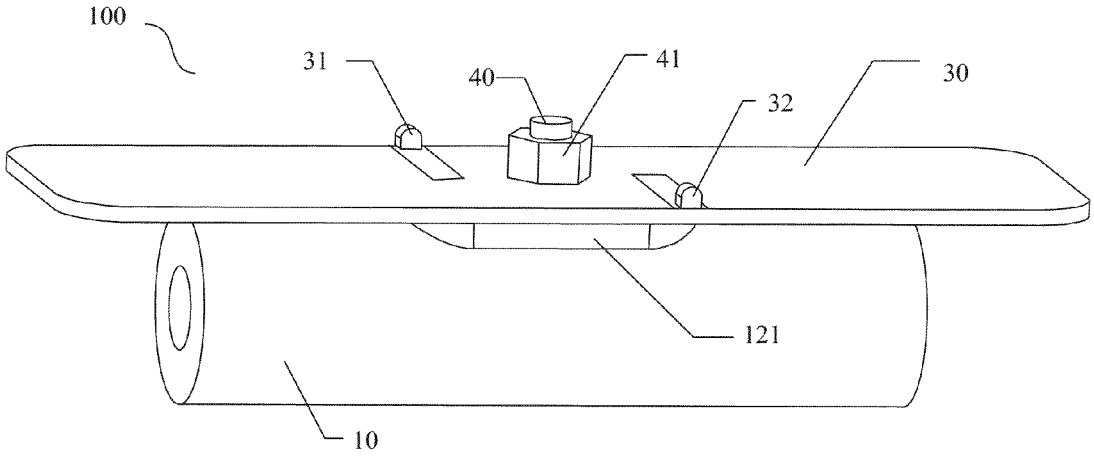
FIG. 3 is a perspective structure view illustrating an adjustable coupling device according to an embodiment of the present disclosure.

The coupling body 20, the coupling circuit and other circuits are fixedly disposed on the printed circuit board 30, and the printed circuit board 30 caps the coupling cavity 11 so as to make the coupling body 20 be enclosed within the coupling cavity 11. The coupling body 20 is fixedly attached on a bottom layer of the printed circuit board 30. The printed circuit board 30 is closely connected with the annular protrusion 121 so as to seal the coupling cavity 11, and thus the coupling body 20 can sample the signals of the inner conductor 13 via the coupling cavity 11. A coupling output terminal 31 and an isolation terminal 32 electrically connected to the coupling body 20 are further disposed on a top layer of the printed circuit board 30. As is shown in FIG. 3, a fixed load is disposed between the isolation terminal 32 and the coupling body 20, and disposed on the top layer of the printed circuit board 30. A signal attenuation circuit is disposed between the coupling output terminal 31 and the coupling body 20, and is disposed on the top layer of the printed circuit board 30. The coupling body 20 may be a microstrip line, and may also be a metal sheet in other embodiments.

A tuner 40 is disposed through the printed circuit board 30, where a lower end of the tuner 40 extends into the coupling cavity 11. The tuner 40 can be moved up and down within the coupling cavity 11 so as to change the depth thereof extended within the coupling cavity 11. The tuner 40 is generally made of metal, with the electric potential thereof being 0. As such, the tuner 40 should not be in contact with the coupling body 20. If the tuner 40 contacts the coupling body 20, then the coupling body 20 cannot acquire the coupling signals. If the tuner 40 is made of non-metallic dielectric materials, then the tuner 40 can be in contact with the coupling body 20. The present inventor found, however, that the tuning effects with, the tuner 40 made of non-metallic dielectric materials is poor. Thus, the tuner 40 is preferably made of metal. In other embodiments, the tuner 40 can also be configured to move left and right or move by other means, whereby the phase and strength of multiple signals coupled to the coupling body 20 can also be tuned, but the printed circuit board 30 and the coaxial transmission line 10 have limited space, thus making the implementation difficult to be achieved.

Figure 4:
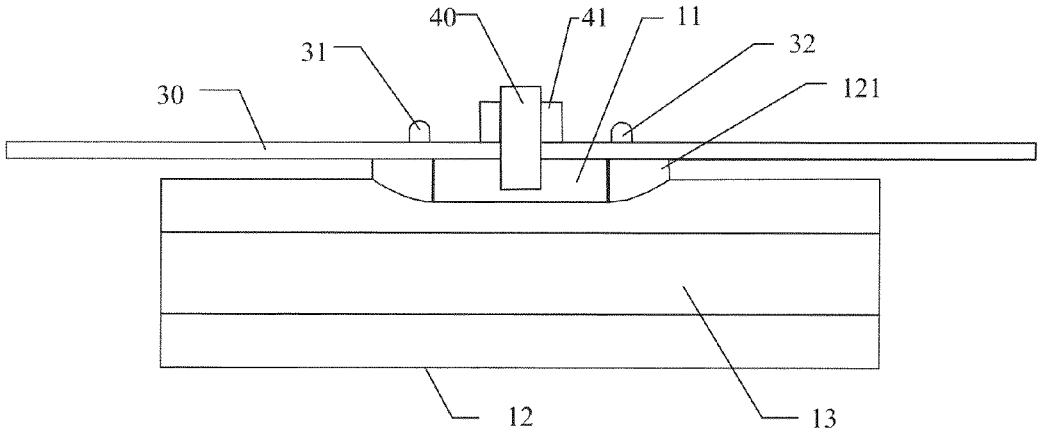
FIG. 4 is a sectional view of an adjustable coupling device according to an embodiment of the present disclosure.
Figure 5:
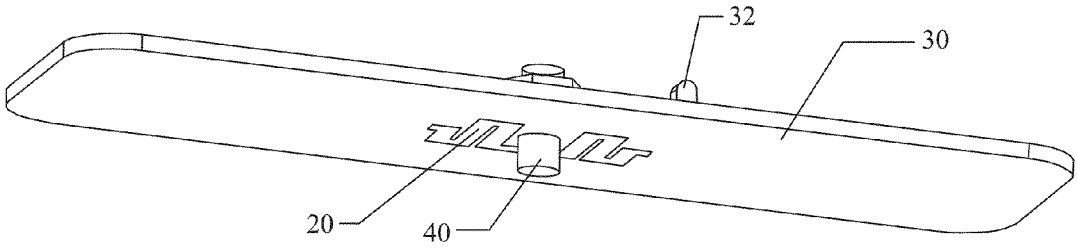
FIG. 5 is a perspective structure view illustrating the mutual cooperation among a printed circuit board, a coupling body and a tuner according to an embodiment of the present disclosure.
Figure 6:
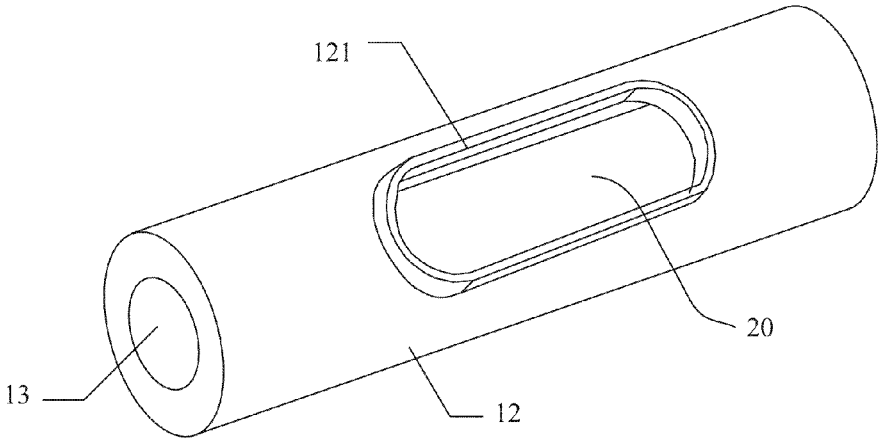
FIG. 6 is a perspective structure view illustrating a coaxial transmission line and a coupling cavity in an adjustable coupling device according to an embodiment of the present disclosure.

According to the embodiments as shown in FIGS. 3~5, the tuner 40 is a tuning bolt, which is fixed on the printed circuit board 30 via a tuner fixing device 41, which is a nut secured on the printed circuit board 30. When tuning, one only needs to rotate the bolt so as to change the depth of the bolt extending into the coupling cavity 11, thus realizing the tuning purpose with extremely simple tuning means. The tuner 40 can certainly be other structures such as, for example, a metal strip; and the tuner fixing device 41 can also be a metal deck, and so on.

Figure 7:
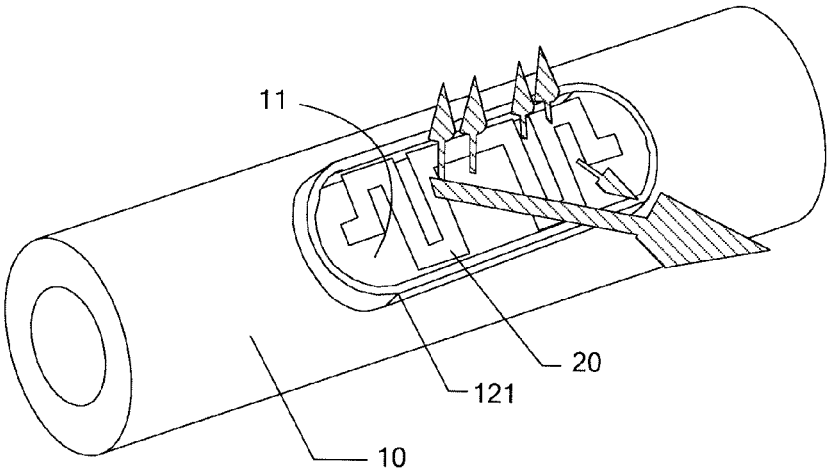
FIG. 7 is a schematic diagram illustrating the distribution of electric field lines within the coupling cavity of an adjustable coupling device according to the present disclosure.

As is shown in FIG. 7, the electromagnetic field generated by the coaxial transmission line 10 penetrates into the coupling cavity 11, and the coupling body 20 samples the electromagnetic signals within the coupling cavity 11. The participation of the tuner 40 alters the distribution of the electromagnetic field within the coupling cavity 11. In fact, the coupling signals mainly influencing the coupling body 20 are the electric field. Hence, the tuner 40 can be moved up and down so as to change the electric field vectors and intensity within the coupling cavity 11, making the coupling amount and signal phase at different portions of the coupling body 20 that are coupled with the electric field different. When the tuner 40 reaches the optimal tuning position, multiple signals coupled to the coupling body 20 by the electric field within the coupling cavity 11 cancel out each other's power. Thus, the power of output signals at the isolation terminal reaches the minimum, i.e., attaining the greatest isolation degree.

In the coupling device 100, the coupling body 20 itself may effectuate a certain isolation degree from the signal input terminal to the isolation terminal 32 of the coaxial transmission line 10. When the tuner 40 interferes the electromagnetic field within the coupling cavity 11, its influence on the isolation degree will be far greater than its influence on the coupling degree as is shown in FIGS. 8~13. Thus, in the present disclosure, it is only needed to add a fixed load at the isolation terminal 32 to achieve a better isolation degree, and only another fixed load (configured to absorb the remaining signal power and produce the impedance matching effects) is needed to add to the isolation terminal 32 of the coupling device 100 to meet the isolation requirements. While the coupling output terminal 31 receives extremely small power influence that no coupling adjustable circuit will be needed. A fixed attenuator circuit can certainly be adopted at the coupling output terminal 31 according to actual needs so as to change the strength of the coupling signals.

Compared against existing coupling devices, the present disclosure obviates the complex coupling circuit with high cost, high failure rate and high level of manufacturing difficulty. A tuner 40 causes perturbation of the internal field within the coupling cavity 11 to adjust indicators (for example, directivity) of the coupling device 100, thus compensating for indicator deterioration derived from various machining errors. When tuning, one only needs to change the depth of the tuner 40 extending into the coupling cavity 11, making the tuning means and structure of the coupling device much simpler. Meanwhile, the coupling body 20 according to the present disclosure is fixed on the printed circuit board 30, and the position of the coupling body 20 will remain unchanged when the tuner 40 is tuned. Compared with existing methods for changing the distance and relative angle between the coupling body and the signal transmission line, connection relations between the coupling body 20 and other circuits on the printed circuit board 30 are stable, with better reliability. Furthermore, the tuning means of each prior art coupling device is relatively complex, making the coupling device not suitable for mass production, while the present disclosure solves this problem.

Figure 8:
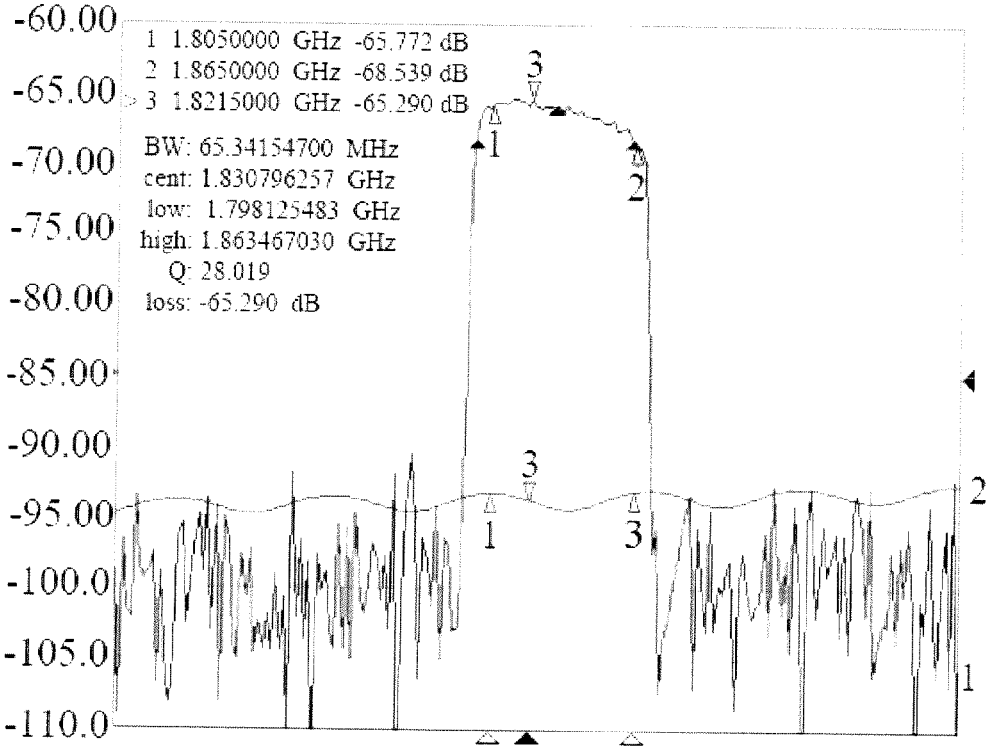
FIG. 8 is a curve graph illustrating attenuation values at an isolation terminal with respect to a signal input terminal of a coaxial transmission line in an adjustable coupling device when a tuner is not tuned according to the present disclosure.
Figure 9:
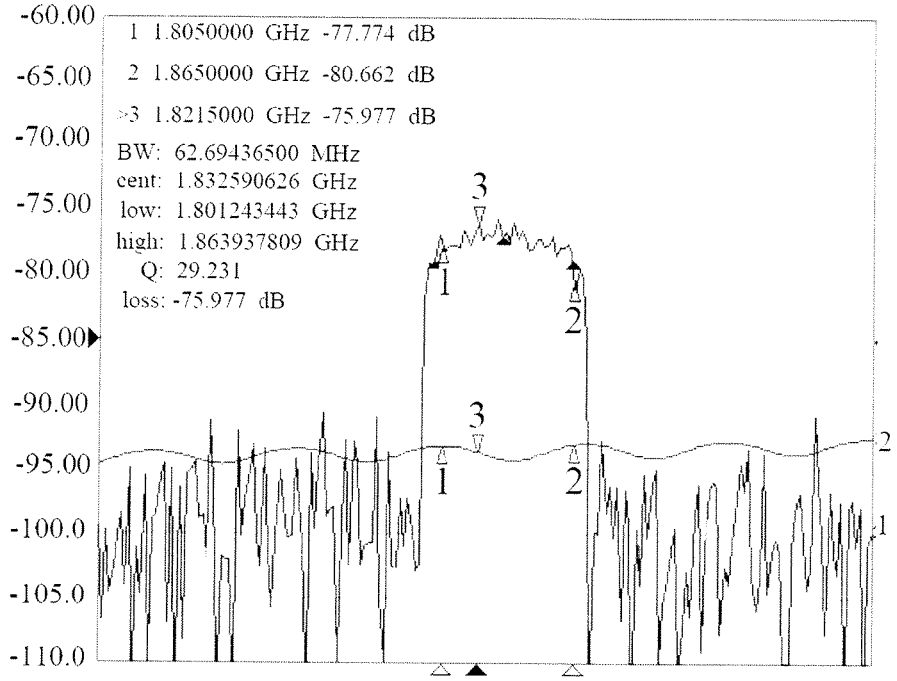
FIG. 9 is a curve graph illustrating attenuation values at an isolation terminal with respect to a signal input terminal of a coaxial transmission line in an adjustable coupling device when the tuner is tuned to an optimal position according to the present disclosure.

FIG. 8 is a curve graph illustrating attenuation values at the isolation terminal with respect to the signal input terminal of the coaxial transmission line in an adjustable coupling device when the tuner is not tuned according to the present disclosure. When the frequency of the input signal in the coaxial transmission line 10 is 1.805 G HZ, then the isolation degree at the isolation terminal 32 is −65.772 db; when the frequency of the input signal in the coaxial transmission line 10 is 1.865 G HZ, then the isolation degree at the isolation terminal 32 is −65.539 db; when the frequency of the input signal in the coaxial transmission line 10 is 1.8215 G HZ, then the isolation degree at the isolation terminal 32 is −65.290 db. FIG. 9 is a curve graph illustrating attenuation values at the isolation terminal with respect to the signal input terminal of the coaxial transmission line in an adjustable coupling device when the tuner is tuned to an optimal position according to the present disclosure. When the frequency of the input signal in the coaxial transmission line 10 is 1.805 G HZ, then the isolation degree at the isolation terminal 32 is −77.774 db; when the frequency of the input signal in the coaxial transmission line 10 is 1.865 G HZ, then the isolation degree at the isolation terminal 32 is −80.662 db; when the frequency of the input signal in the coaxial transmission line 10 is 1.8215 G HZ, then the isolation degree at the isolation terminal 32 is −75.977 db. It can be analyzed from the above data that, when the tuner is tuned to the optimal position, the isolation degree at the isolation terminal 32, when compared with the case when no tuning is performed, increases by at least 10 db.

Figure 10:
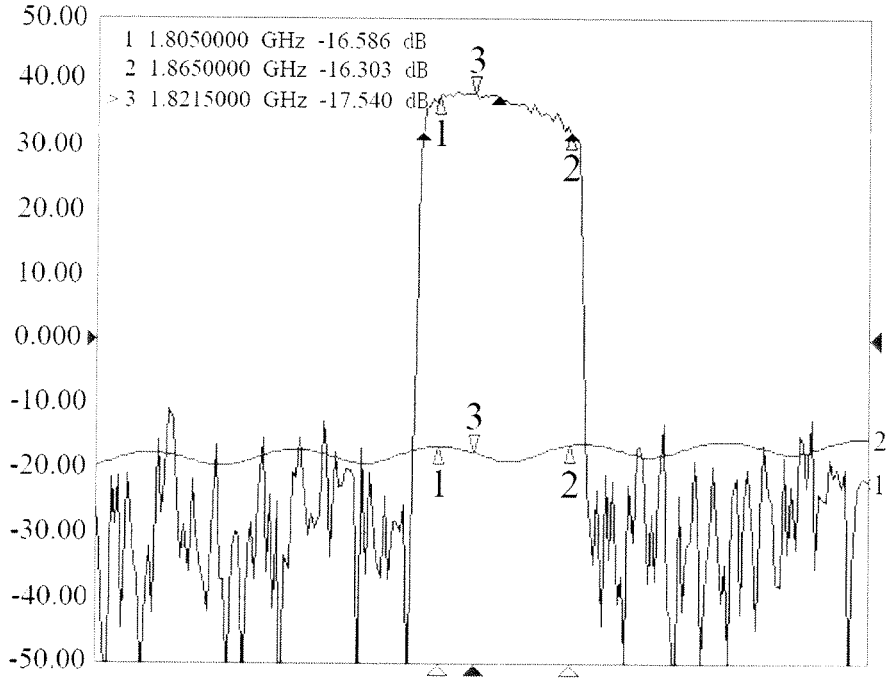
FIG. 10 is a curve graph illustrating the return loss at a coupling output terminal of an adjustable coupling device when the tuner is not tuned according to the present disclosure.
Figure 11:
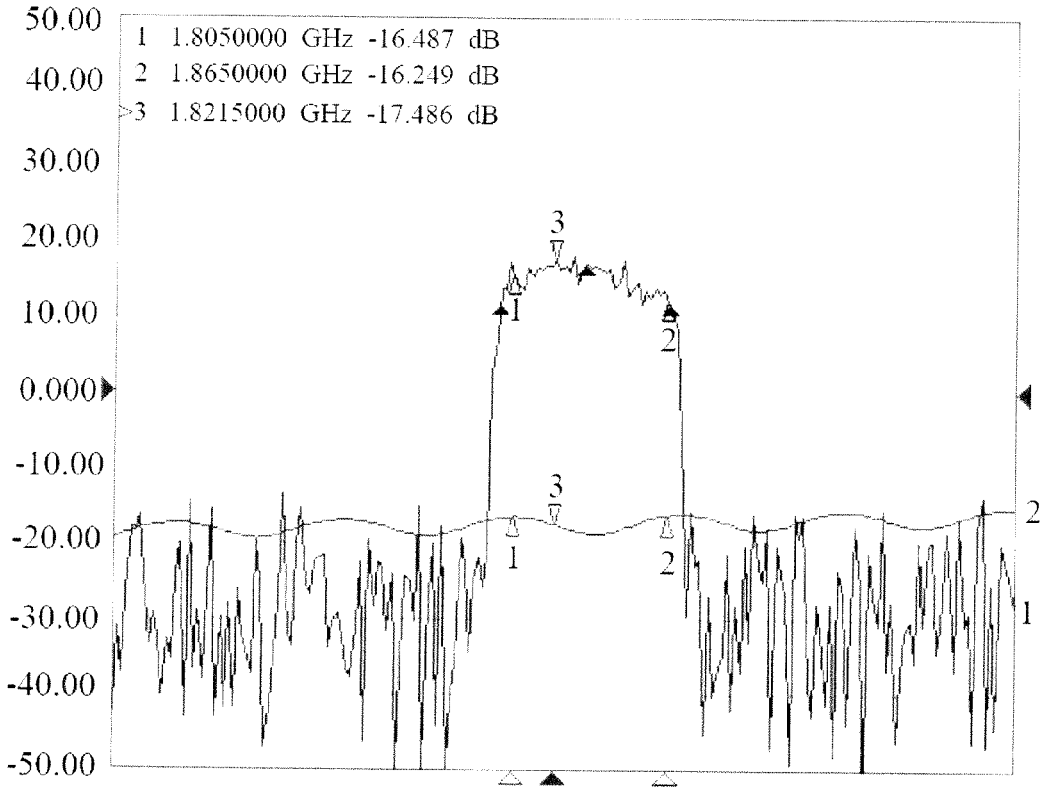
FIG. 11 is a curve graph illustrating the return loss at the coupling output terminal of an adjustable coupling device when the tuner is tuned to an optimal position according to the present disclosure.

FIG. 10 is a curve graph illustrating the return loss at a coupling output terminal of an adjustable coupling device when the tuner is not tuned according to the present disclosure. When the frequency of the input signal in the coaxial transmission line 10 is 1.805 G HZ, then the return loss value at the coupling output terminal 31 is −16.586 db; when the frequency of the input signal in the coaxial transmission line 10 is 1.865 G HZ, then the return loss value at the coupling output terminal 31 is −16.303 db; when the frequency of the input signal in the coaxial transmission line 10 is 1.8215 G HZ, then the return loss value at the coupling output terminal 31 is −17.450 db. FIG. 11 is a curve graph illustrating the return loss at the coupling output terminal of the adjustable coupling device when the tuner is tuned to an optimal position according to the present disclosure. When the frequency of the input signal in the coaxial transmission line 100 is 1.805 G HZ, then the return loss value at the coupling output terminal 31 is −16.487 db; when the frequency of the input signal in the coaxial transmission line 10 is 1.865 G HZ, then the return loss value at the coupling output terminal is −16.249 db; when the frequency of the input signal in the coaxial transmission line 10 is 1.8215 G HZ, then the return loss value at the coupling output terminal 31 is −17.486 db. It can be analyzed from the above data that, when the tuner is tuned to the optimal position, the return loss at the coupling output terminal 31, when compared with the case when no tuning is performs, has an extremely small variation in the return loss.

Figure 12:
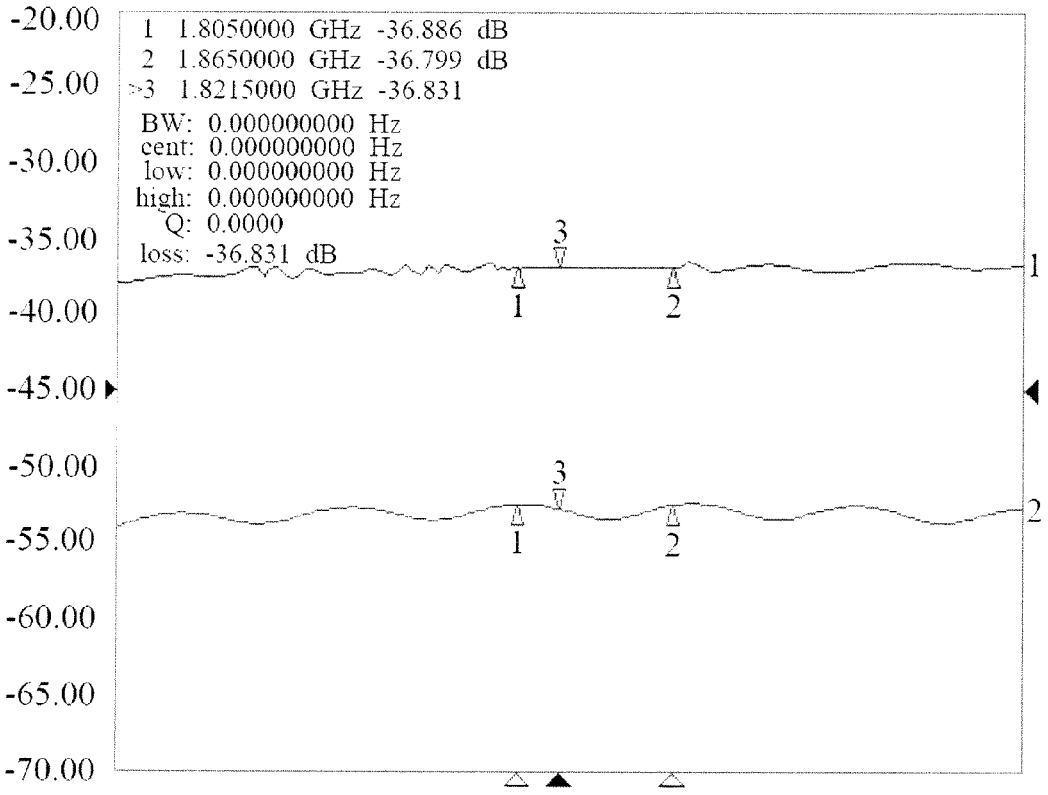
FIG. 12 is a curve graph illustrating the coupling amount at the coupling output terminal of an adjustable coupling device when the tuner is not tuned according to the present disclosure.
Figure 13:
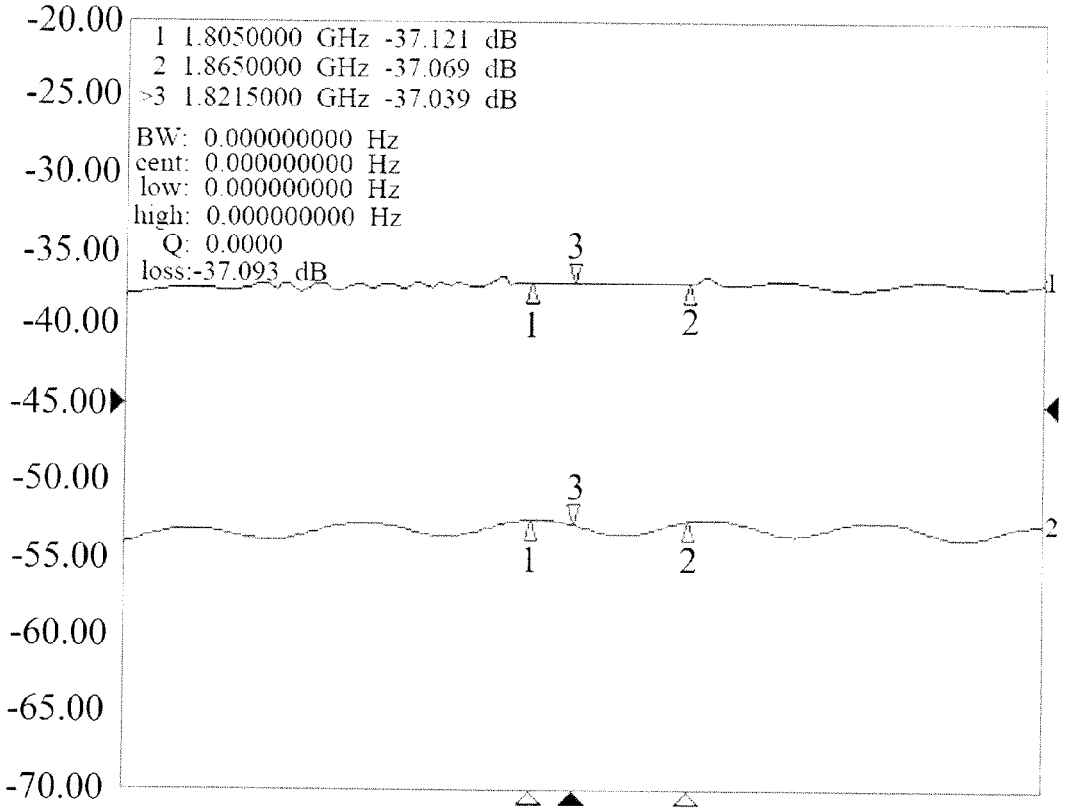
FIG. 13 is a curve graph illustrating the coupling amount at the coupling output terminal of an adjustable coupling device when the tuner is tuned to an optimal position according to the present disclosure.

FIG. 12 is a curve graph illustrating the coupling amount at the coupling output terminal of an adjustable coupling device when the tuner is not tuned according to the present disclosure. When the frequency of the input signal in the coaxial transmission line 10 is 1.805 G HZ, then the coupling amount at the coupling output terminal 31 is −36.886 db; when the frequency of the input signal in the coaxial transmission line 10 is 1.865 G HZ, then the coupling amount at the coupling output terminal is −36.799 db; when the frequency of the input signal in the coaxial transmission line 10 is 1.8215 G HZ, then the coupling amount at the coupling output terminal 31 is −36.831 db. FIG. 13 is a curve graph illustrating the coupling amount at the coupling output terminal of an adjustable coupling device when the tuner 40 is tuned to an optimal position according to the present disclosure. When the frequency of the input signal in the coaxial transmission line 10 is 1.805 G HZ, then the coupling amount at the coupling output terminal 31 is −37.121 db; when the frequency of the input signal in the coaxial transmission line 10 is 1.865 G HZ, then the coupling amount at the coupling output terminal is −37.069 db; when the frequency of the input signal in the coaxial transmission line 10 is 1.8215 G HZ, then the coupling amount at the coupling output terminal 31 is −37.093 db. It can be analyzed from the above data that, when the tuner is tuned to the optimal position, the coupling amount at the coupling output terminal 31, when compared with the case when no tuning is performed, has an extremely small variation in the coupling amount.

It can be seen that in conjunction with FIGS. 8-13, after using the tuner 40 of the present disclosure, the tuner 40 effectuates a great optimization on the isolation degree at the isolation terminal 32 (compared with the prior art, the isolation degree increases much). And the tuner 40 has virtually no influence on the return loss value and the coupling amount at the coupling output terminal 31, thus only a fixed load needs to be added at the isolation terminal 32; while at the coupling output terminal 31, the coupling signals can be directly outputted, or a signal attenuation circuit with no tuning function can also be added according to actual conditions.

Compared with the prior art, the present disclosure adopts an simple device with low cost, high reliability, and favorable for mass production, replacing the conventional complex coupling circuit with high cost, high failure rate and high level of manufacturing difficulty. A tuner 40 causes perturbation of the internal field within the coupling cavity 11 to adjust indicators (for example, the directivity) of the coupling device 100 so as to compensate for indicator deterioration derived from various machining errors. When tuning, one only needs to change the depth of the tuner 40 extending into the coupling cavity 11, making the tuning means and the structure of the coupling device much simpler.

The present disclosure further provides a radio frequency communication device, which includes a signal transmission member and the above mentioned adjustable coupling device 100. The radio frequency communication device is a cavity filter, a simplex device, a duplexer, a multiplexer, a combiner or a demultiplexer. Since specific structure of the adjustable coupling device 100 is described in detail in the above description, thus it will not be detailed herein.

In view of the above, according to the present disclosure, a coupling cavity is applied on the outer surface of the coaxial transmission line, a printed circuit board caps the coupling cavity, and a coupling body disposed on the printed circuit board is enclosed within the coupling cavity. A tuner extends through the printed circuit board into the coupling cavity, and can be moved up and down to change the depth thereof extending into the coupling cavity so as to change electromagnetic field distribution within the coupling cavity, and thus further make the coupling amount and signal phase at different portions of the coupling body different. When the tuner is tuned to the optimal position, multiple signals coupled to the isolation terminal of the coupling body by the electric field within the coupling cavity cancel out each other's power, making the output power of signals at the isolation terminal reach the minimum (i.e., attaining the greatest isolation degree), while the output power at the coupling output terminal receives extremely small influence. A fixed load (configured to absorb the remaining signal power and produce the impedance matching effects) will only be needed at the isolation terminal of the coupling device to meet the isolation requirements, and due to the extremely small influence on the coupling output terminal, the coupling adjustable circuit won't be needed. The present disclosure thus obviates the conventional complex coupling circuit with high cost, high failure rate and high level of manufacturing difficulty. A tuner causes perturbation of the internal field within the coupling cavity to adjust indicators (for example, the directivity) of the coupling device, thus compensating for indicator deterioration derived from various machining errors.

In tuning, one only needs to change the depth of the tuner extended into the coupling cavity, while the position of the coupling body remains stationary, and the connection relations between the coupling body and other circuits on the printed circuit board are stable, thus further improving the reliability and achieving much simpler tuning means and coupling device structure. In this way, the present disclosure has a simple structure and thus eliminates the influence on the coupling device derived from the structure and the machining accuracy and assembly techniques of the printed circuit board, with simple tuning means and high reliability. Meanwhile, the present disclosure is more suitable for mass production.

The above embodiments are merely intended for illustrating the technical concept and characteristics of the present disclosure, and enabling those that are familiar with this technology to understand the contents of the present disclosure and implement it accordingly, which thus shouldn't be construed to limit the protection scope of the present disclosure. Any equivalent variants and modifications made according to scope of claims of the present disclosure shall all fall within the coverage of the claims of the present disclosure.

What is claimed is:

1. An adjustable coupling device, comprising:

a coaxial transmission line configured to transmit signals across its two terminals;

a coupling body configured to sample the signals through coupling;

a coupling cavity formed on an outer surface of the coaxial transmission line;

a printed circuit board on which the coupling body is fixedly disposed, the printed circuit board capping the coupling cavity so as to enclose the coupling body within the coupling cavity; and a tuner, disposed through the printed circuit board, comprising a lower end extending into the coupling cavity, the tuner being capable of moving up and down so as to change depth extending into the coupling cavity to change distribution of electromagnetic field within the coupling cavity.

2. The adjustable coupling device according to claim 1, wherein the coaxial transmission line comprises an outer conductor and inner conductor; a window is defined in the outer conductor of the coaxial transmission line, and an annular protrusion is disposed surrounding the window outside the coaxial transmission line so as to form the coupling cavity.

3. The adjustable coupling device according to claim 2, wherein the annular protrusion is separately or integrally provided with the outer conductor of the coaxial transmission line.

4. The adjustable coupling device according to claim 1, wherein the coupling body is a microstrip line.

5. The adjustable coupling device according to claim 1, wherein the coupling body is a metal sheet.

6. The adjustable coupling device according to claim 1, wherein the coupling body is fixed on a bottom layer of the printed circuit board.

7. The adjustable coupling device according to claim 1, wherein a coupling output terminal and an isolation terminal that are electrically connected to the coupling body are further disposed on a top layer of the printed circuit board.

8. The adjustable coupling device according to claim 7, wherein a fixed load is disposed between the isolation terminal and the coupling body, and disposed on the top layer of the printed circuit board.

9. The adjustable coupling device according to claim 7, wherein a signal attenuation circuit is disposed between the coupling output terminal and the coupling body, and disposed on the top layer of the printed circuit board.

10. The adjustable coupling device according to claim 7, wherein when the tuner is in an optimal position, a plurality of signals coupled to the isolation terminal of the coupling body by the electric field within the coupling cavity cancel out each other's power, with output power of signals at the isolation terminal reaching a minimum.

11. The adjustable coupling device according to claim 1, wherein the tuner is a tuning bolt.

12. The adjustable coupling device according to claim 1, wherein the tuner is fixed on the printed circuit board via a tuner fixing device.

13. The adjustable coupling device according to claim 12, wherein the tuner fixing device is a nut or a metal deck secured on the printed circuit board.

14. The adjustable coupling device according to claim 1, wherein a cress section of the coaxial transmission line is a circle or a square.

15. The adjustable coupling device according to claim 1, wherein the printed circuit board is closely connected with the annular protrusion so as to seal the coupling body.

16. A radio frequency communication device, wherein the radio frequency communication device comprises a signal transmission member and the adjustable coupling device according to claim 1.

17. The radio frequency communication device according to claim 16, wherein the radio frequency communication device is a cavity filter, a simplex device, a duplexer, a multiplexer, a combiner or a demultiplexer.

18. The adjustable coupling device according to claim 1, wherein the tuner is moved up and down so as to change electric field vectors within the coupling cavity to make coupling amount and signal phase at different portions of the coupling body that are coupled to the electric field different.

* * * * *